US006637053B1

(12) United States Patent
DiNapoli et al.

(10) Patent No.: US 6,637,053 B1
(45) Date of Patent: Oct. 28, 2003

(54) MATTRESS

(76) Inventors: Saverio DiNapoli, 68 Birch Meadow Outlook, Woodbridge, Ontario (CA), L4L 9M6; Dino Antonacci, 250 Pinegrove, Apt 206, Woodbridge, Ontario (CA), L4L 9M6; Eddie DelRizzo, 28 Rowley Drive, Woodbridge, Ontario L0N 1P0 (CA)

( * ) Notice: Subject to any disclaimer, the term of this patent is extended or adjusted under 35 U.S.C. 154(b) by 0 days.

(21) Appl. No.: 10/179,616

(22) Filed: Jun. 7, 2002

(51) Int. Cl.[7] ..... A47C 23/06
(52) U.S. Cl. ..... 5/236.1; 5/238
(58) Field of Search ..... 5/740, 236.1, 238, 5/655.9, 953

(56) References Cited

U.S. PATENT DOCUMENTS

| | | | | | |
|---|---|---|---|---|---|
| 51,755 | A | * | 12/1865 | Schott | 5/236.1 |
| 104,182 | A | * | 6/1870 | Merritt | 5/238 |
| 131,198 | A | * | 9/1872 | Wehrle | 5/238 |
| 180,392 | A | * | 7/1876 | Turner | 5/236.1 |
| 2,638,606 | A | * | 5/1953 | Austin | 5/236.1 X |
| 4,827,544 | A | * | 5/1989 | Husler | 5/236.1 |
| 5,233,709 | A | * | 8/1993 | Horry | 5/236.1 |
| 5,495,629 | A | * | 3/1996 | Husler | 5/236.1 |
| 5,553,338 | A | * | 9/1996 | Amann | 5/236.1 |
| 5,916,086 | A | * | 6/1999 | Rossdeutscher | 5/236.1 |
| 5,926,872 | A | * | 7/1999 | Rossdeutscher | 5/236.1 |
| 6,122,779 | A | * | 9/2000 | Meili et al. | 5/236.1 |
| 6,298,505 | B1 | * | 10/2001 | Brivio | 5/236.1 |

FOREIGN PATENT DOCUMENTS

| | | | | |
|---|---|---|---|---|
| BE | 572539 | * | 11/1958 | 5/238 |
| WO | WO 91/01099 A | * | 2/1991 | 5/236.1 |

* cited by examiner

*Primary Examiner*—Robert G. Santos
(74) *Attorney, Agent, or Firm*—Elias C. Borges

(57) ABSTRACT

The present invention is a mattress which consists of a series of elongated foam members positioned adjacent each other in parallel, a plurality of foam blocks separating each elongated foam member, a series of parallel slots formed along one surface of each elongated foam member, and a series of elongated slats mounted perpendicularly to the foam members. The slats are dimensioned and configured to fit within the slots of adjacent foam members such that the slats lie flush with respect to the surface of each foam member. The slats are held in place on each foam member by elongated webs which are bonded to the surface of each foam member. Each web extends between the opposite ends of the foam member and is dimensioned to cover over the slats where the slats overlap the foam member. The mattress construction also includes a mattress cover which encloses the foam members and slats.

20 Claims, 3 Drawing Sheets

MATTRESS

FIELD OF THE INVENTION

The invention relates generally to bed mattresses.

BACKGROUND OF THE INVENTION

A majority of bed mattresses on the market today generally consist of a plurality of coil springs linked together to form a mattress core, overtop of which is layered a foam and cloth cover. The coil spring core acts to distribute the user's weight as he or she sleeps on the mattress. The foam and cloth cover protects the coil spring core and adds to the comfort of the mattress by helping to distribute the user's weight. A properly constructed mattress supports the user's weight evenly, thereby maintaining good posture and comfort. The resilient strength of the coil springs sets the firmness of the mattress, the firmer the springs used, the firmer the resulting mattress.

While coil spring mattress are very popular, there are other types of mattresses which provide superior comfort and durability. Foam core mattresses are particularly popular, since the solid foam core incorporated into these mattresses are very effective in supporting the user's body weight in a uniform and comfortable manner. The foam used in these solid foam core mattresses must be of higher density and superior resiliency, which tends to make these mattresses more expensive. Another superior mattresses construction combines a series of elongated foam cores with a series of wooden slats perpendicularly arranged on top of the foam cores. The wooden slats are attached to the foam cores by a plurality of fabric pockets which are sewn together to form a cover for the foam core. The slats are inserted into the pockets and then the foam core is inserted into the slat and cover combination. A thick mattress covering, or topper, is then covered over the foam core and slat combination. This slat and foam construction results in a mattress having superior comfort and support; however, the cost of assembly tend to make such mattresses prohibitively expensive.

SUMMARY OF THE INVENTION

In accordance with the present invention, the present invention overcomes the drawbacks of the prior art by providing a mattress which combines the superior comfort of slat and foam core construction, yet is economical and easy to construct. The mattress construction of the present invention consists of a series of elongated foam members positioned adjacent each other in parallel, a plurality of foam blocks separating each elongated foam member, a series of parallel slots formed along one surface of each elongated foam member, the slots extending perpendicularly across the surface of each foam member, and a series of elongated slats mounted perpendicularly to the foam members. The slats are dimensioned and configured to fit within the slots of adjacent foam members such that the slats lie flush with respect to the surface of each foam member. The slats are held in place on each foam member by an elongated web which is bonded to the surface of each foam member. Each web extends between the opposite ends of each foam member and is dimensioned to cover over the slats where the slats overlap the foam member. Finally, the mattress construction includes a mattress cover which encloses the foam members and slats.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
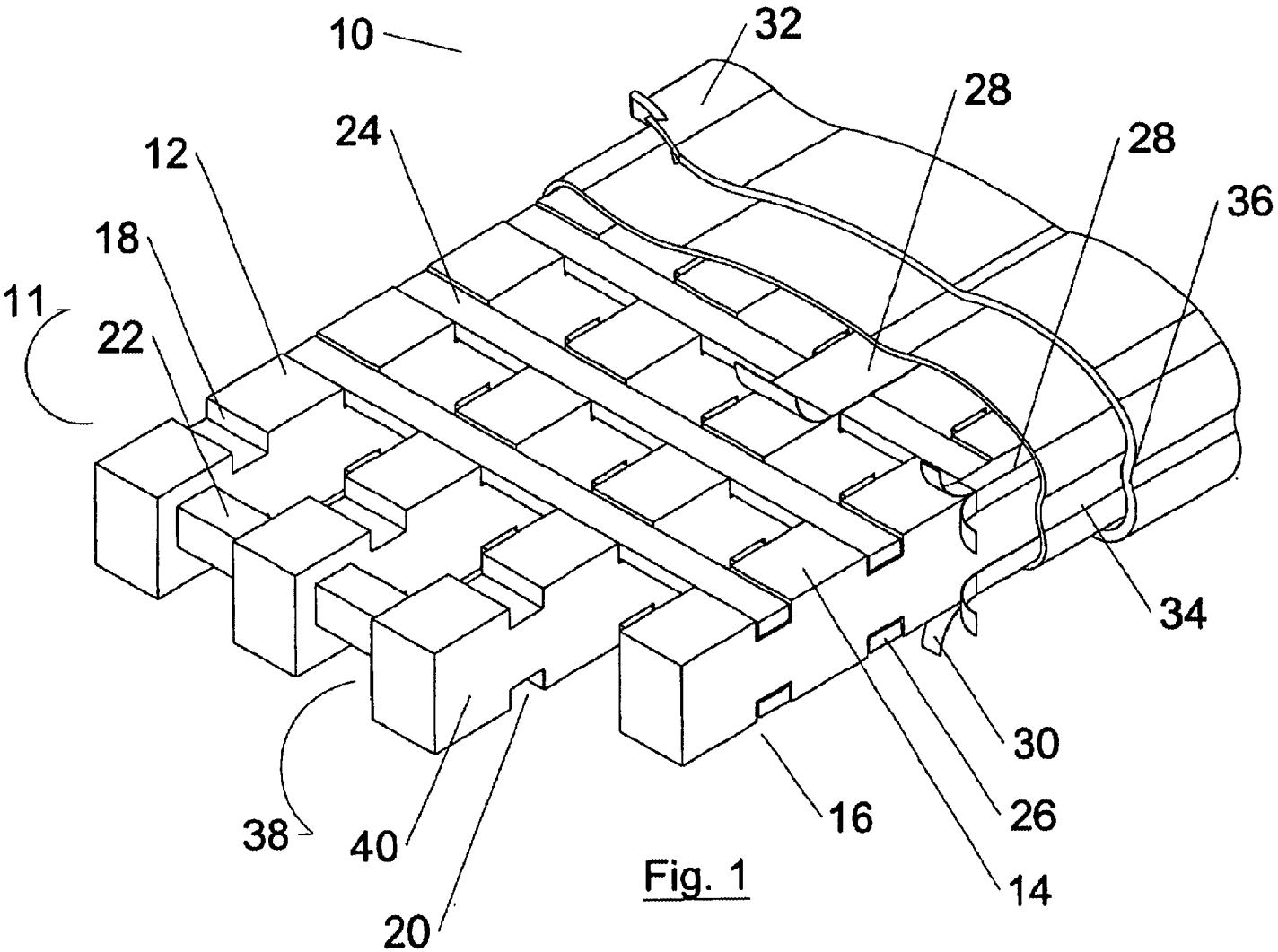
FIG. 1. is a perspective view of a mattress made in accordance with the present invention, partly in section showing the internal construction of the mattress.

Referring firstly to FIG. 1, a mattress made in accordance with the present invention is shown generally as FIG. 1 and includes a mattress core 11 and a mattress cover 32. Mattress core 11 consists of a series of parallel foam members having opposite surfaces 14 and 16. A series of parallel slots 18 and 20 are formed perpendicularly on surfaces 14 and 16 of each foam member 12. Each foam member 12 is separated by a foam block 22, which is dimensioned to keep foam members 12 in parallel orientation. Preferably foam block 22 is rectangular. A series of elongated slats 24 and 26 are attached to opposite surfaces 14 and 16, respectively. Each slat 24 is dimensioned to fit snugly-within slots 18 such that the slat lies flush with surface 14. Likewise, each slat 26 is dimensioned to fit snugly within slots 20 such that the slat lies flush with surface 16. Slats 24 are held in place within slots 18 by a series of elongated webs 28 which are bonded to surfaces 14 of each foam member 12. Likewise, slats 26 are held in place within slots 20 by a series of elongated webs 30 which are bonded to surfaces 14 of each foam member 12. Webs 28 and 30 extend the entire length of each foam member 12 and each web is sufficiently wide to hold slats 24 and 26 securely in place. Mattress 10 also includes a cover 32 which is dimensioned and configured to cover over core 11. Cover 32 includes a foam padding 34 and a topper 36.

Foam members 12 are made of a high density yet resilient foam material such as polyurethane or latex rubber. Foam members 12 are generally rectangular in shape. The length of members 12 determine the length of mattress 10. The thickness of members 12, as measured between surfaces 14 and 16, will define the loft of the finished mattress. The thicker the foam members are, the loftier the finished mattress and, generally speaking, the more comfortable the mattress will be. The thickness of foam members 12 is dependent on the desired loft of the finished mattress and the density of the foam used in forming the foam members. The width of foam members 12 is also important. The width of foam members 12 should be selected to support members 24 and 26 sufficiently to prevent the mattress from collapsing when a user rests on the finished mattress. If foam members 12 are too wide, then the mattress may be too firm and, since more foam will be used in the construction of the mattress, the price of the finished mattress may be too high.

Foam blocks 22 are positioned between foam members 12 and help keep the foam members in parallel orientation.

Foam blocks 22 are positioned between foam members 12 such that each block bears against side surfaces 38 and 40 of adjacent foam members. Blocks 22 are positioned at the ends of foam members 12 to ensure that they adequately provide the foam members with sufficient lateral support to keep the members in parallel orientation. Preferably, foam blocks 22 are positioned between foam members 12 at opposite ends of the foam members in order to reinforce what will become the head and foot ends of the finished mattress. Foam blocks 22 may be adhered to foam members 12 by means of an adhesive.

Figure 2:
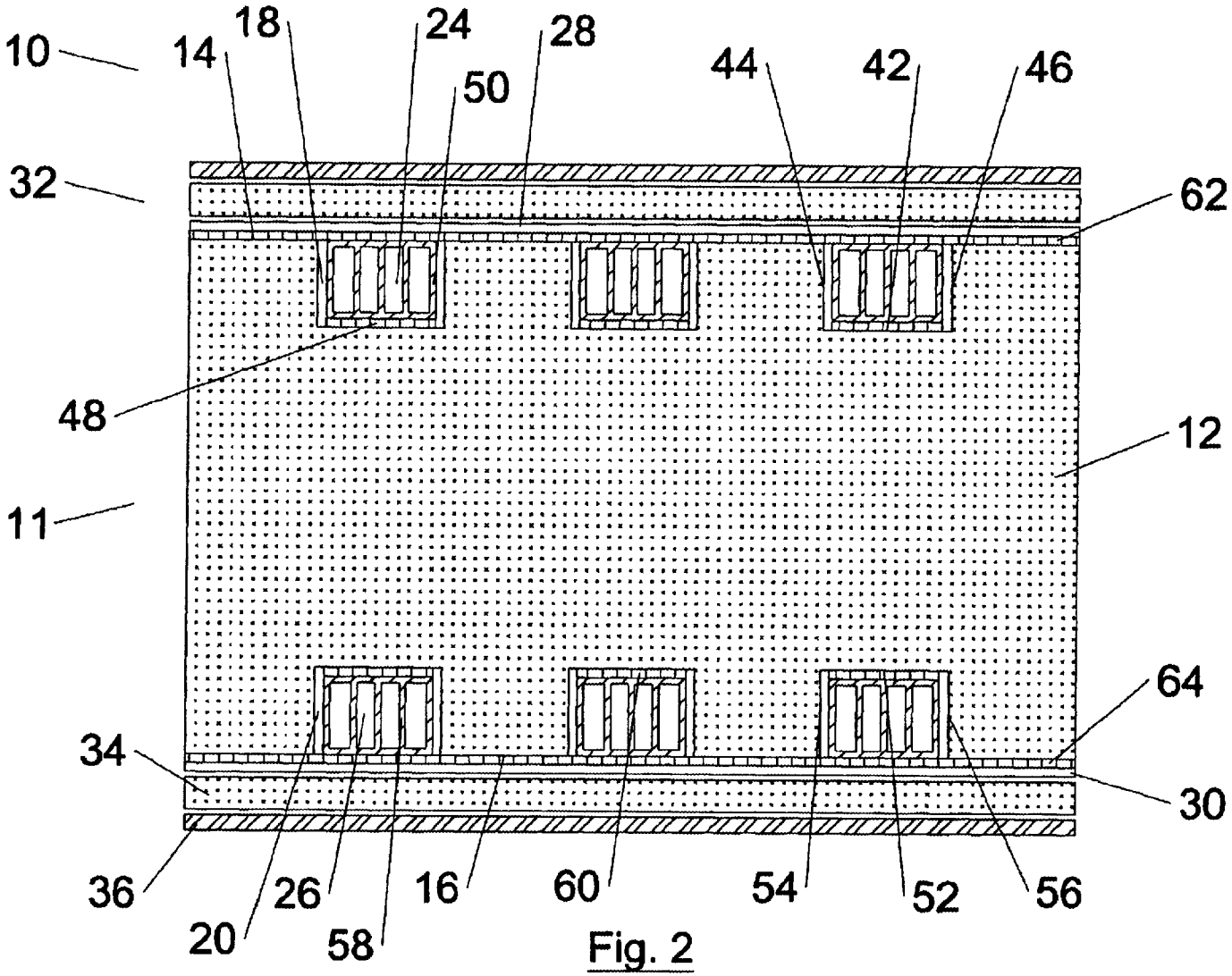
FIG. 2. is a cross sectional view of a portion of the mattress shown in FIG. 1.

Referring now to FIG. 2, each slat 24 consists of an elongated extrusion of a thermoplastic such as polypropylene, PVC or the like. Each slat will have a plurality of reinforcing ribs 50, which adds to the structural strength of the slats. The dimensions of slats 24 and slots 18 are selected to permit the slats to fit snugly in the slots. The dimensions of each slot 18 is defined by floor 42 and side walls 44 and 46. The width of slot 18 and the width of slat 24 are dimensioned to allow slat 24 to fit snugly between walls 44 and 46. The depth of slot 18 is defined as the distance between floor 42 and surface 14. The depth of slot 18 and the thickness of slat 24 are selected such that when the slat is inserted into the slot, the slat lies substantially flush with surface 14. Slat 24 is preferably attached floor 42 by adhesive layer 48.

Slats 26 are identical to slats 24. Like slats 24, slats 26 have at least one reinforcing rib 58 which give slats 26 greater structural strength. The width of slots 20 and the width of slats 26 are selected such that the slats fit snugly between walls 54 and 56. Slats 26 are secured to ceiling 52 of each slot 20 by adhesive layer 60. The thickness of slats 26 and the depth of slots 20 are selected to permit slats 26 to lie flush relative to surface 16 when the slats are inserted into slots 20.

Slats 24 and 26 are secured in slots 18 and 20 by webs 28 and 30, respectively. Webs 28 and 30 are each adhered onto surfaces 14 and 16 by adhesive layers 62 and 64, respectively. Webs 28 and 30 are preferably made of a strong cloth material.

Figure 3:
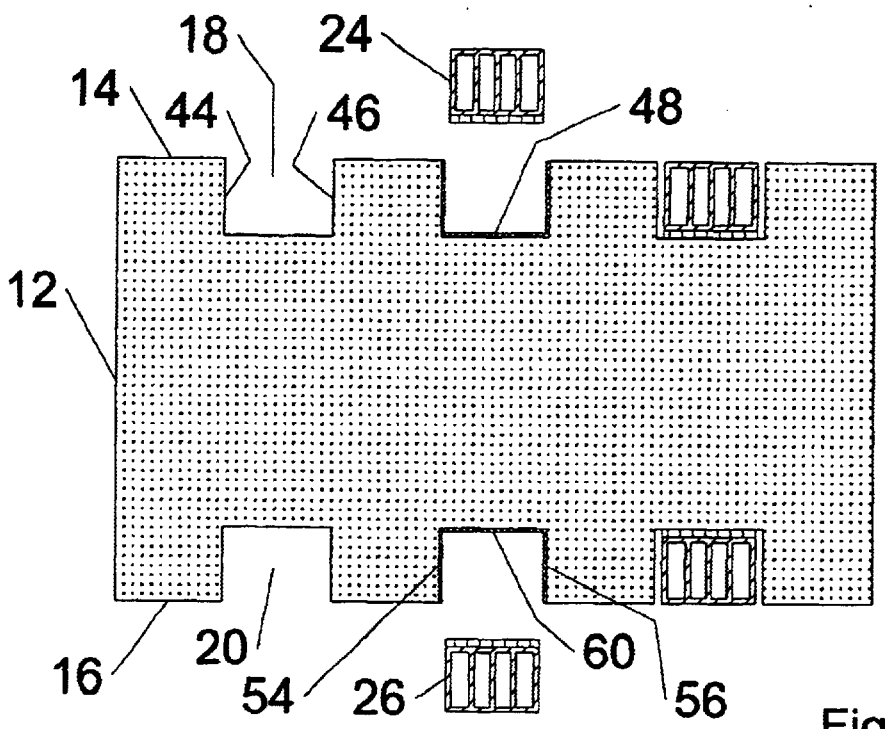
FIG. 3. is a cross sectional view of a partially constructed mattress made in accordance with the present invention.
Figure 4:
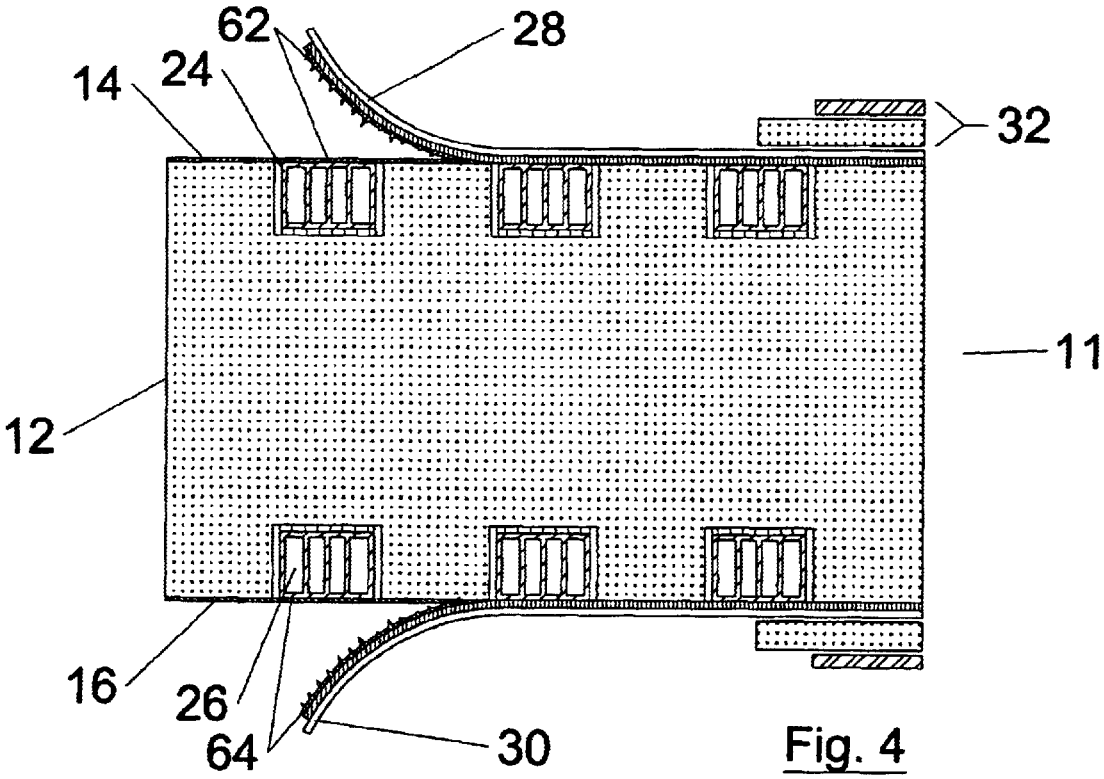
FIG. 4. is a cross sectional view of the mattress shown in FIG. 3 which has been further assembled.

Referring now to FIGS. 3 and 4, the method of constructing a mattress made in accordance with the present invention shall now be discussed. The first step in the process is to coat the inside surfaces of slots 18 and 20 with an adhesive to form adhesive layers 48 and 60, respectively. After adhesive layers 48 and 60 are formed, slats 24 and 26 are then inserted into their respective slots. The adhesive used to form adhesive layers 48 and 60 must be capable of bonding the slat material to the foam material forming member 12. Several suitable textile grade foam adhesives are commercial available. After members 24 and 26 are mounted to foam member 12, web 28 and 30 are then applied to surfaces 14 and 16, respectively. Adhesive layers 62 and 64 are applied to the surface of foam member 12 adjacent to and between slats 24 and 26, respectively, and the webs are then pressed against foam member 12. The adhesive used to bond webs 28 and 30 to foam member 12 is selected to bind fabric to the foam rubber material forming member 12. Preferably, the same adhesive used to form adhesive layers 48 and 60 is also used to form adhesive layers 62 and 64. After a suitable curing period, mattress core 11 is then sealed inside mattress cover 32 and the finished mattress is ready for packaging.

The slat in groove construction used in the present invention has several advantages over prior slat and foam mattress constructions. It will be appreciated that when a user sleeps on a mattress, considerable torsional and transverse forces are applied to the slats. Prior art slat and foam mattress constructions used rectangular foam members with slats attached to the outer surfaces of the foam members. To secure the slats on the foam members and prevent them from moving from side to side, prior art mattress constructions used a series of fabric envelopes which were sewn to an elongated web. This greatly increased the cost of constructing the mattress since the slats had to be individually loaded into each envelope before the entire slat and envelope construction could be mounted over top of the foam core. Furthermore, these prior art mattresses required a very thickly padded mattress cover to smooth over the bumpy surface created by the slats lying over top of the foam core. The present invention overcomes these disadvantages by recessing the slats into the foam core, thereby greatly increasing the ease of assembly and decreasing the amount of padding required for the mattress cover. Since slats 24 and 26 and slots 18 and 20 are dimensioned such that the slats lie substantially flush relative to the surfaces of the foam members, the surface of mattress core 11 will be substantially flat. Since mattress core 11 is substantially flat, applying webs 28 and 30 can be accomplished easily by means of rollers or the like (not shown). Furthermore, since slats 24 and 26 rest snugly in slots 18 and 20, respectively, walls 44 and 46 of slots 18 and walls 54 and 56 of the slots help steady the slats and prevent them from moving when a user sleeps on the mattress. The walls of the slots apply most of the resistive force required to prevent the slats from moving relative to foam members 12. This eliminates the need for retaining the slats in a series of envelopes.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

What is claimed is:

1. A mattress construction comprising:

a) a plurality of elongated foam members positioned adjacent each other in parallel, each of the foam members having opposite first and second ends, a first surface and opposite side surfaces;

b) a plurality of foam blocks separating each elongated foam member, the foam blocks dimensioned and configured to keep the elongated foam members in parallel, c) each foam member having a plurality of parallel slots formed along the first surface, the slots extending perpendicularly across the first surface of each foam member;

d) a plurality of elongated slats overlapping the foam members, each slat dimensioned and configured to fit within the slots of adjacent foam members such that the slats lie flush with respect to the first surface of each foam member, each slat extending perpendicularly across each foam member;

e) each foam member having an elongated web bonded to the first surface and extending between the opposite ends, the web dimensioned to cover over the slats where the slats overlap the foam members, and f) a mattress cover enclosing the foam members and slats.

2. A mattress as defined in claim 1 wherein each web is bonded to each slat.

3. A mattress as defined in claim 1 wherein each foam member has a second side opposite the first side and wherein a plurality of elongated slots are formed along the second side of each foam member and further comprising a plurality of elongated slats overlapping the second side of the foam members, each slat dimensioned and configured to fit within the slots of adjacent foam members such that the slats lie flush with respect to the second surface of each foam member, each slat extending perpendicularly across each foam member, each foam member having an elongated web bonded to the second surface and extending between the opposite ends, the web dimensioned to cover over the slats where the slats overlap the foam members.

4. A mattress construction comprising:

a) a plurality of elongated foam members positioned adjacent each other in parallel, each of the foam member having opposite first and second ends and opposite first and second surfaces;

b) each foam member having a plurality of parallel slots formed along the first surface;

c) a plurality of elongated slats overlapping the foam members, the slats positioned adjacent each other in parallel, the slats dimensioned and configured to fit within the slots of the foam members such that the slats lie flush with respect to the first surface of the foam members, and d) a plurality of elongated webs bonded to the first surface of the foam members, the webs dimensioned to cover over the slats where the slats overlap the foam members.

5. A mattress as defined in claim 4 further comprising a topper cover enclosing the foam members and slats.

6. A mattress as defined in claim 4 wherein the slats are bonded to the foam members by an adhesive.

7. A mattress as defined in claim 6 wherein the slats are held in the slots by an adhesive bond formed between the slats and the slots.

8. A mattress as defined in claim 4 wherein the slats are perpendicularly arranged relative to the foam members.

9. A mattress as defined in claim 4 firer comprising a series of block members, the block members being positioned between the foam members, the block members dimensioned to maintain the foam members in parallel.

10. A mattress as defined in claim 4 further comprising a second plurality of elongated slots formed on the second surface of the foam members and a second plurality of elongated slats overlapping the second surface of the foam members, the slats positioned adjacent each other in parallel, the slats dimensioned and configured to fit within the slots of the foam members such that the slats lie flush with respect to the first surface of the foam members.

11. A mattress as defined in claim 4 wherein the webs extend along the first surface of the foam members between the opposite ends.

12. A mattress as defined in claim 11 wherein the webs are also bonded to the slats.

13. A mattress construction comprising:

a) a plurality of elongated foam members positioned adjacent each other in parallel, each of the foam member having opposite first and second ends and opposite first and second surfaces;

b) each foam member having a plurality of parallel slots formed within the first surface;

c) a plurality of elongated slats overlapping the foam members, the slats positioned adjacent each other in parallel, the slats dimensioned and configured to fit within the slots of the foam members such that the slats lie within the slots, and d) a plurality of elongated webs bonded to the first surface of the foam members, the webs dimensioned to cover over the slats where the slats overlap the foam members.

14. A mattress as defined in claim 13 further comprising a topper cover enclosing the foam members and slats.

15. A mattress as defined in claim 13 wherein the slats are bonded to the foam members by an adhesive.

16. A mattress as defined in claim 15 wherein the slats are held in the slots by an adhesive bond formed between the slats and the slots.

17. A mattress as defined in claim 13 wherein the slats are perpendicularly arranged relative to the foam members.

18. A mattress as defined in claim 13 further comprising a series of block members, the block members being positioned between the foam members, the block members dimensioned to maintain the foam members in parallel.

19. A mattress as defined in claim 13 further comprising a second plurality of elongated slots formed on the second surface of the foam members and a second plurality of elongated slats overlapping the second surface of the foam members, the slats positioned adjacent each other in parallel, the slats dimensioned and configured to fit within the slots of the foam members such that the slats lie flush with respect to the first surface of the foam members.

20. A mattress as defined in claim 13 wherein the webs extend along the first surface of the foam members between the opposite ends and wherein the webs are bonded to the slats.

* * * * *